US007882568B2

(12) United States Patent
Fee

(10) Patent No.: US 7,882,568 B2
(45) Date of Patent: Feb. 8, 2011

(54) TWO PIECE KNEE PAD

(76) Inventor: Terence Fee, 18 Mohawk Dr., Clarendon Hills, IL (US) 60415

( * ) Notice: Subject to any disclaimer, the term of this patent is extended or adjusted under 35 U.S.C. 154(b) by 384 days.

(21) Appl. No.: 11/458,578

(22) Filed: Jul. 19, 2006

(65) Prior Publication Data

US 2008/0021363 A1 Jan. 24, 2008

(51) Int. Cl.
*A41D 13/00* (2006.01)

(52) U.S. Cl. ..... 2/24

(58) Field of Classification Search ..... 2/16, 2/22, 24, 252, 62, 911
See application file for complete search history.

(56) References Cited

U.S. PATENT DOCUMENTS 5,450,625 A * 9/1995 Hu ..... 2/16
5,527,267 A 6/1996 Billotti
5,594,954 A 1/1997 Huang
5,656,023 A * 8/1997 Caprio et al. ..... 602/63
5,727,252 A 3/1998 Oetting et al.
5,823,981 A 10/1998 Grim et al.
6,070,267 A 6/2000 McKewin
6,085,353 A * 7/2000 van der Sleesen ..... 2/69
6,253,376 B1 7/2001 Ritter
6,317,888 B1 11/2001 McFarlane
6,374,409 B1 * 4/2002 Galy ..... 2/24
6,402,712 B1 6/2002 Gauvry
6,485,448 B2 11/2002 Lamping et al.
6,584,616 B2 7/2003 Godshaw et al.
6,654,962 B2 12/2003 DeMott
6,743,325 B1 6/2004 Taylor
6,820,279 B2 11/2004 Lesosky
6,851,124 B2 2/2005 Munoz et al.
6,968,573 B2 * 11/2005 Silver ..... 2/227

OTHER PUBLICATIONS

The Japanese Box and Knee Brace, publication date unknown, 2 pages.

* cited by examiner

*Primary Examiner*—Tejash Patel
(74) *Attorney, Agent, or Firm*—Fitch, Even, Tabin & Flannery

(57) ABSTRACT

A two piece knee pad is provided comprising a stabilizer strap and a releasable pad portion that may be attached to the stabilizer strap. The releasable pad may be attached or detached as needed, and allows for ventilation of the knee without removal of the entire apparatus.

15 Claims, 3 Drawing Sheets

TWO PIECE KNEE PAD

FIELD

This disclosure relates to a two piece knee pad which includes (1) a stabilizer strap made of flexible, stretchable material, and (2) an attachable protective pad which protects the knee and removably attaches to the stabilizer strap.

BACKGROUND

Knee pads are commonly used for protecting knees in sporting and leisure activities. Traditional knee pads only provide a protective function and not a support function. These traditional protective knee pads have rigid pads, often of the hard plastic "shell" type, with straps to keep the pads in place. The straps do not provide a support function. Some knee pads are designed as a sleeve that slides onto the wearer's leg over the foot, while others have detachable straps that are secured to the pad and wrap around the back of the wearer's knee. The straps, which often extend around the back of the leg, also tend to slide because there generally is not an attachment structure over and under the knee to keep a pad in place. Straps fastening behind the knee are ordinarily ineffective in preventing slippage, since there are no protruding surfaces on the back of the leg to hold the straps in place vertically along the length of the upright leg. Moreover, the straps going around the back of the knee are uncomfortable for the wearer because these straps are often relatively thin and dig into flesh in the back of the knee. This can be particularly painful during knee flexion, when the straps can be pinched between the flesh of the rear thigh and calf. Further, a rigid pad may impair movement and does not generally allow the pad to flex with the knee during activity.

Orthopedic supports sometimes have some sort of padding associated therewith, but these types of supports have not provided the desired flexibility and comfort for the wearer. Another problem that arises with support type of pads is that they tend to be warm and tend to fit snugly around the knee, causing perspiration to accumulate between the support and the wearer's leg. Ventilation around the knee may not be available when the pad is in place. Therefore, removal of the pad is necessary to allow for ventilation. Unfortunately, removal of the pad may require removal of the entire knee pad assembly if the pad is removable at all. This problem is particularly acute in knee pads used in sporting events such as volleyball, basketball, soccer, tennis, lacrosse, wrestling and other sports, where a soft, sleeve-type pad is used, necessitating the wearer to remove his or her shoes in order to remove the knee pad. A flexible knee pad which is easy to put on without removal of shoes or other pieces of apparel, that readily permits pad replacement, and that also supports the wearer's knee (or other joints) as well as permits some ventilation is desirable.

SUMMARY

A unique two piece knee pad is described herein. The knee pad provides support to the wearer's knee(s) and also provides the wearer with a pad to protect the knee(s) from impact. The flexible two piece knee pad includes a knee cap stabilizer strap and an attachable, releasable pad that is releasably attached to the stabilizer strap. The stabilizer strap supports the knee area and includes a back support panel and two forked portions each of which have a top arm and a bottom arm. These arms wrap around above and below a human knee to anchor the strap to a wearer's leg and do not dig into the wearer's flesh. As the arms are wrapped around the wearer's leg, a first top arm is secured to a second top arm above the knee cap, while a first lower arm is secured to a second lower arm below the knee cap. Since the arms are secured above and below the knee cap itself on the front side of the leg, the knee cap stabilizer strap is held in place vertically by the protruding knee cap nested between the secured top and bottom arms. The arms above and below the knee not only stabilize the strap, but also provide a window for ventilation of the knee. The pad covers and protects this window when the pad is attached to the strap. The window is formed by the two forked portions of the stabilizer strap when the strap is secured to the wearer, and is bounded on the top and bottom by the secured upper and lower arms, respectively.

When the strap is laid flat and open the forked portions extend from the back support panel such that the top and bottom arms of each forked section extend away from the top and bottom arms of the other forked section. The back support panel is relatively small and fits along the back of the leg in the area posterior to the knee cap for support, but because it is small it is comfortable and minimizes the area of the leg which is covered by the strap. At the same time, the support panel covers a sufficient surface area that it will not dig into the wearer's flesh or become pinched between the thigh and calf of the wearer during flexion of the knee, as is the case with thinner straps. Therefore, the configuration of the strap provides not only support, but comfort and stability as well.

The attachable, releasable pad is releasably attached to the knee cap stabilizer strap. The attachable, releasable pad is positioned and releasably attached on the stabilizer strap to cover the window for the knee created by the strap such that the releasable pad will protect the knee when it is attached to the stabilizer strap. The removable pad need not be worn when an athlete is warming up, allowing for some ventilation on the leg and knee, and can later easily be attached after warm ups without the necessity of securing a number of straps or removing a shoe or other piece of apparel.

Additional advantages of this two-piece knee pad include the ability to replace either the stabilizer strap or the releasable pad without the need to replace the entire knee pad assembly. This is particularly useful in cases where the releasable pad receives significantly more wear than the stabilizer strap. In addition, releasable pads may be interchanged to create new and exciting color combinations.

BRIEF DESCRIPTION OF THE DRAWINGS

Embodiments of the various aspects of the invention will now be described by way of example with reference to the accompanying drawings.

DETAILED DESCRIPTION

Figure 1:
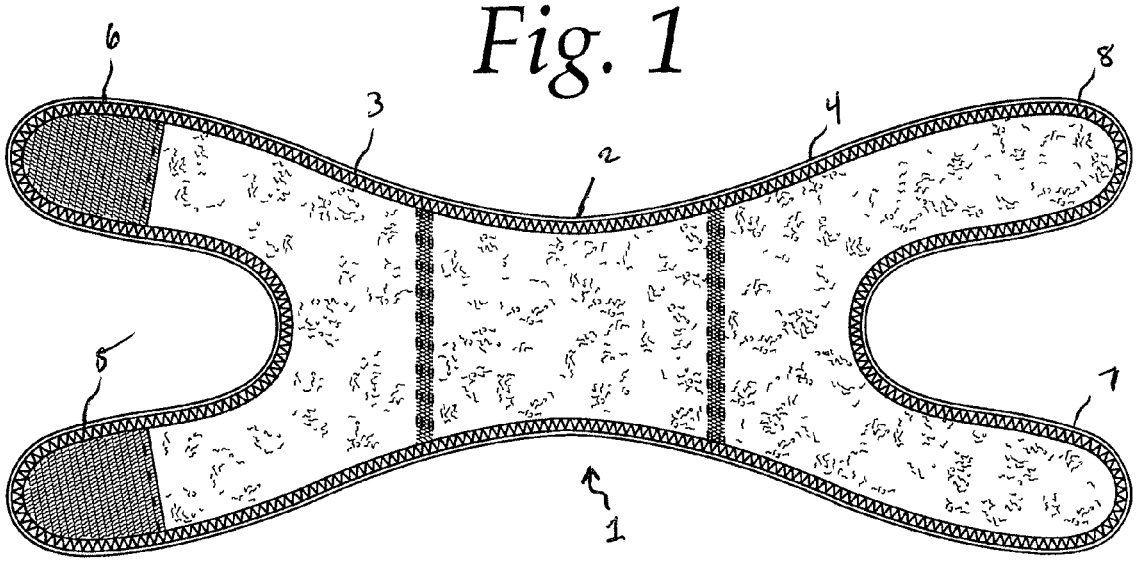
FIG. 1 depicts the exterior of a stabilizer strap in open formation.
Figure 2:
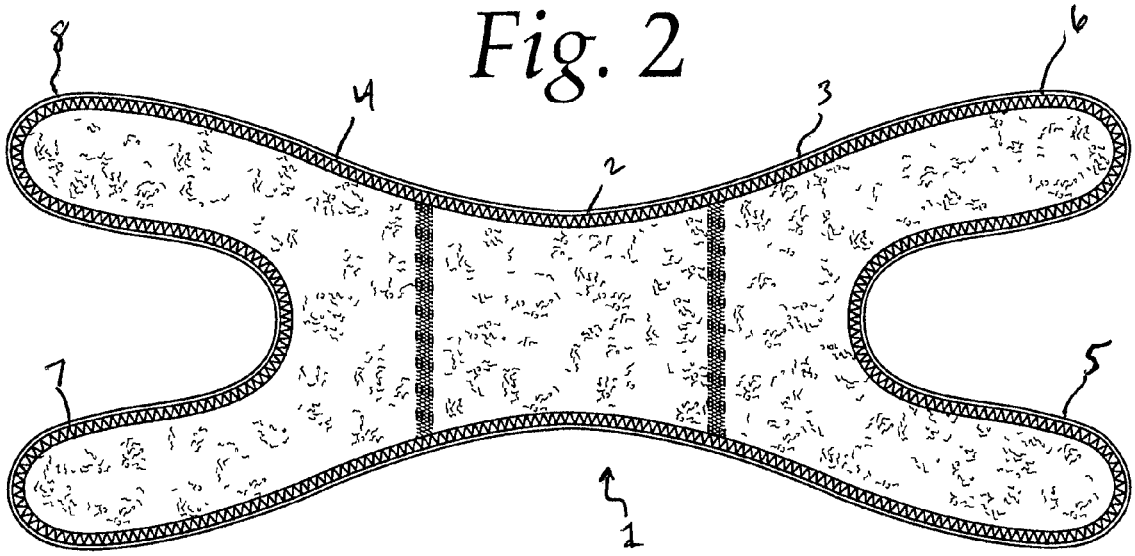
FIG. 2 depicts the interior of a stabilizer strap in open formation.

With reference to FIGS. 1 and 2, the flexible two piece knee pad disclosed herein includes a knee cap stabilizer strap 1 and a releasable pad 9 (FIG. 4) which is releasably attached to the stabilizer strap. The stabilizer strap 1 comprises a back support panel 2 and two forked portions 3 and 4. Each of the forked portions have a top arm and a bottom arm. Means for securing the arms of one forked portion to the arms of the other forked portion are provided. Preferably, the arms of one forked portion are equipped with overlapping mating sections that are complimentary to mating sections located on the other forked portion. For instance, VELCRO™ or similar devices may be used, wherein the arms of one forked portion may contain a strip of nylon comprising a multiplicity of tiny nylon hooks that become secured to complementary fabric loops on the arms of the opposite forkwhen the hooks are overlaid on the loops. Alternatively, the arms of one fork may be equipped with larger hooks, buttons, buckles, clasps, or similar devices for interaction with complementary structures on the other fork.

The forked portions 3 and 4 extend from opposite sides of the back support panel 2 such that the top and bottom arms of each forked section extend away from the top and bottom arms of the other forked section. The back support panel 2 is relatively narrow from top to bottom and fits along the back of the leg in the area dorsal/posterior to the knee cap for support, but because of its relatively small size is comfortable and minimizes the area of the leg which is covered by the strap. At the same time, the support panel 2 covers a sufficient surface area that it will not dig into the wearer's flesh or become pinched between the thigh and calf of the wearer during flexion of the knee, as is the case with thinner straps. The proximal end of each forked portion is attached to the back support panel 2. The forked portions 3 and 4 comprise arms that extend away from the back support panel 2 at their distal ends.

The stabilizer strap 1 is made of flexible, stretchable material, and has an inner surface and an outer surface. The interior and exterior of the stabilizer strap are preferably made of the same material.

Figure 4:
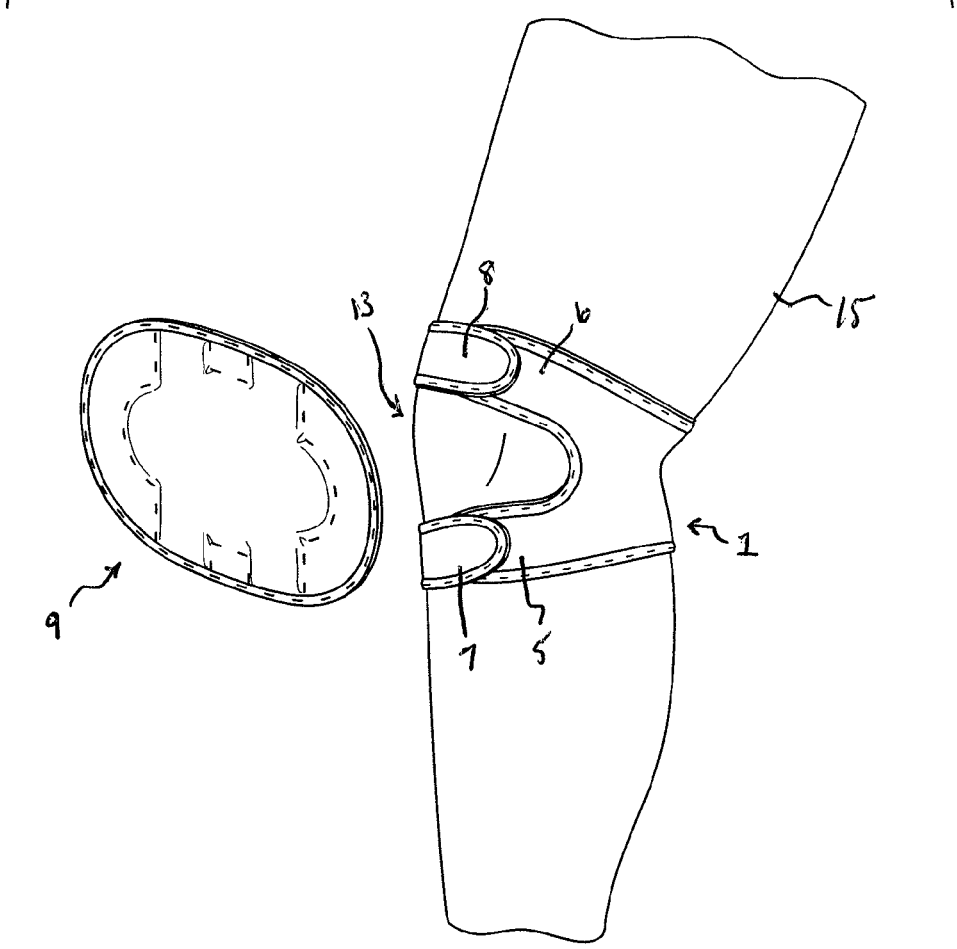
FIG. 4 depicts a stabilizer strap in closed formation, secured to a human knee. The releasable pad remains unattached.

As shown in FIG. 4, as the arms are wrapped horizontally around the circumference of the wearer's leg 15, the end portions of the arms 5 and 6 of one of the forked portions 3 contact the arms 7 and 8 from the other forked portion 4, allowing the securing means to secure the two sets of arms together. The first top arm 6 is secured to a second top arm 8 above the knee cap, while a first lower arm 5 is secured to a second lower arm 7 below the knee cap. Preferably, nylon hooks on the first top arm 6 are secured to looped fabric material on the second upper arm 8. Likewise, preferably nylon hooks on the first lower arm 5 are secured to looped fabric material on the second lower arm 7. Securing the two sets of arms creates a window 13 which exposes the wearer's knee between the secured upper arms and secured lower arms. This window 13 allows for ventilation of the exposed knee even while the stabilizer strap is in place. Securing the arms both above and below the knee also serves to better hold the stabilizer strap in place, since the knee cap will protrude through the window 13, thereby preventing vertical movement of the stabilizer strap along the wearer's leg.

Preferably, the entire stabilizer strap is comprised of stretchable looped fabric material that may interact with a multiplicity of nylon hooks located on the upper arm 6 and lower arm 5 of the first forked portion 3. This will allow for maximum adaptability, since the nylon hooks on upper arm 6 and lower arm 5 of the first forked portion 3 may be secured anywhere along the length of the second forked portion 4. In this way, a stabilizer strap may be made to fit legs of almost any size.

Figure 3:
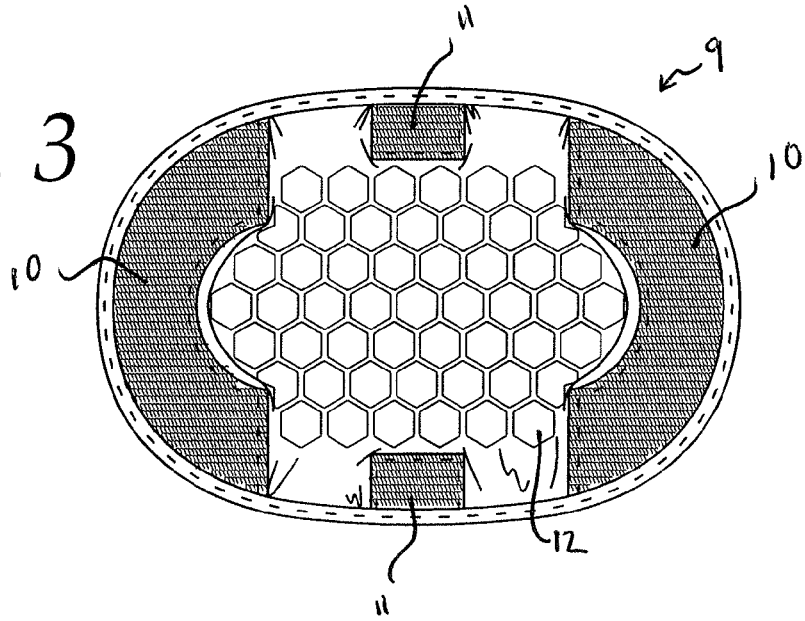
FIG. 3 depicts the interior of a releasable pad.

The attachable, releasable pad 9 is formed as a separate structure configured to attach to the exterior of the stabilizer strap. As seen in FIG. 3, the pad 9 has an inner surface and an outer surface, the inner surface being designed to attach to the knee cap stabilizer strap 1. The exterior of the releasable pad is preferably made of the same stretchable fabric material as the preferred stabilizer strap. The releasable pad has a thickness for protecting the knee from external forces, and is preferably equipped with a cushion 12 mounted on the interior surface in order to absorb external shocks and cushion the knee. Attachment means are provided on the interior surface of the releasable pad for attaching the pad to the stabilizer strap. Preferably, these attachment means are located on the peripheral area of the inner surface of the releasable pad. Attachment of the pad to the stabilizer strap covers and protects the window 13 formed by the secured upper and lower arms of the stabilizer strap. Preferably, attachment means are located both on the side edges 10 and top and bottom edges 11 of the releasable pad. The attachment means secure the pad 9 to the exterior of the stabilizer strap 1 when it is in the closed formation around the wearer's knee. The attachment means may be, for instance, a first mating section of a "hook and loop" fastener, which may overlie and be attached to an underlying second mating section of the hook and loop fastener located on the outer surface of the stabilizer strap. Preferably, the attachment means on the interior surface of the pad comprise a multiplicity of nylon hooks that may be secured to looped fabric material on the exterior of the stabilizer strap. Alternatively, the attachment means may comprise larger hooks, buttons, buckles, clasps, or similar structures configured to interact with and releasably attach to the stabilizer strap.

Preferably, the cushion 12 of the pad 9 comprises a plurality of polyhedral foam elements made from a resilient closed-cell polyethylene foam, as described in U.S. Pat. No. 6,743,325. These polyhedrons may form a repeating pattern of cubes, hexagonal prisms, or octagonal prisms, preferably of side approximately 8 mm, joined with a hot melt adhesive to fabric substrates so that the foam elements are sandwiched between and attached to two fabric layers. The polyhedrons are preferably evenly arranged, each cube being spaced from adjacent polyhedrons by approximately 2 mm. The fabric is a resiliently stretchable knitted fabric, preferably one comprising polyester or elastic fibers. The stretchable fabric used in connection with the invention may be made of synthetic fabric which is readily stretchable and expandable, preferably comprising expandable nylon/SPANDEX warp knit fabric treated with an INTERA process available from Intera Company, Limited. The treated fabric is available from Darlington company located in Augusta, Ga. In describing characteristics of the preferred treated fabric, the fabric is said to have "four-way stretch," being capable of substantial stretching in different coplanar directions (e.g., perpendicular or other nonparallel directions taken along the plane of the fabric). While most fabrics "stretch" to some extent, the fabric from which the cushion 12 and pad 9 are formed has a much greater extent of stretching. For example, certain "non-stretch" fabrics may expand on the order of 10% to 20% when placed under substantial tension, oftentimes greater than that experienced under normal wearing conditions. The present invention, however, contemplates fabric which readily stretches 50% to 200% when tensioned under normal wearing conditions. The present invention also contemplates fabric having so-called "two-way" stretch, i.e., stretch in opposite (parallel) directions along a common direction line. As understood, so-called "four-way stretch" fabrics are typically made of artificial fibers woven with a warp knit and so-called "two-way stretch" fabrics are typically made of artificial fibers woven with a circular knit.

Referring back to FIG. 1, the exterior of one embodiment of the stabilizer strap is shown. The stabilizer strap 1 comprises a back support panel 2 and two forked portions 3 and 4. The first forked portion 3 contains first upper arm 6 and first lower arm 5. The second forked portion 4 contains second upper arm 8 and second lower arm 7. FIG. 1 shows an area of nylon hook material on each of arms 5 and 6 for securing those arms to the loop material of arms 7 and 8, respectively.

The forked portions 3 and 4 extend from the back support panel 2 in opposite directions. The back support panel 2 is tapered toward the middle to provide minimal interference with the area in back of (dorsal/posterior to) the knee.

FIG. 2 shows the interior surface of the stabilizer strap depicted in FIG. 1. The interior of the stabilizer strap is in contact with the leg of the wearer during use, and therefore the majority of its surface is covered primarily by a soft and comfortable fabric. At least arms 7 and 8 of forked portion 4 are configured to interact with the nylon hook material on the exterior of arms 5 and 6. In the embodiment shown in FIG. 2, essentially the entire interior surface of the stabilizer strap is covered in a flexible, stretchable loop material that may be secured to the nylon hook material on the exterior of arms 5 and 6.

FIG. 3 shows the interior surface of the releasable pad 9. A cushion 12 is provided in the center of the pad in order to cushion the knee. In the embodiment shown in FIG. 3, the cushion comprises a plurality of hexagonal prisms of a resilient closed-cell polyethylene foam, of side approximately 8 mm joined with a hot melt adhesive to fabric substrates. The hexagonal prisms are evenly arranged, each cube being spaced from adjacent cubes by approximately 2 mm. The fabric is a resiliently stretchable knitted fabric, preferably one comprising polyester or elastic fibers, such as synthetic nylon/SPANDEX warp knit fabric treated with an INTERA process available from Intera Company, Limited. The preferred fabric has so-called "four-way stretch," being capable of substantial stretching in different coplanar directions (e.g., perpendicular or other nonparallel directions taken along the plane of the fabric). While most fabrics "stretch" to some extent, the fabric from which the knee brace is preferably formed has a much greater extent of stretching. The present invention, however, contemplates fabric which readily stretches 50% to 200% when tensioned under normal wearing conditions. The present invention also contemplates fabric having so-called "two-way" stretch, i.e., stretch in opposite (parallel) directions along a common direction line. As understood, so-called "four-way stretch" fabrics are typically made of artificial fibers woven with a warp knit and so-called "two-way stretch" fabrics are typically made of artificial fibers woven with a circular knit.

Mating sections 10 and 11 of the pad are located on the peripheral area of the inner surface of the releasable pad 9. The mating sections attach to the stabilizer strap 1 and secure the pad 9 to the exterior of the stabilizer strap when the strap is in the closed formation around the wearer's knee. The attachment means along the side edges 10 attach to the bodies of the first and second forked portions 3 and 4 of the stabilizer strap 1. The attachment means along the top and bottom edges 11 attach the pad to the upper and lower arms of the stabilizer strap 1. In the embodiment shown in FIG. 3, the side attachment means 10 are the primary means to attach the pad to the stabilizer strap. Top and bottom attachment means 11 of the pad function to further close off the knee area. Preferably, the attachment means 10 and 11 on the interior surface of the pad are strips of nylon comprising a multiplicity of tiny hooks that may be secured to looped fabric material on the exterior of the stabilizer strap. The central cushion 12 is located inward from the peripheral area.

With reference to FIG. 4, the stabilizer strap is shown in closed formation secured to the wearer's leg 15. In the closed formation, the arms of the stabilizer strap wrap around the wearer's leg. The securing means (not shown) on first upper arm 6 are secured to second upper arm 8 and the securing means on first lower arm 5 are secured to second lower arm 7. The first top arm 6 is secured to a second top arm 8 above the knee cap, while a first lower arm 5 is secured to a second lower arm 7 below the knee cap. Securing the arms forms a window 13 that reveals the wearers knee, providing ventilation and securing the strap vertically along the leg by fixing upper and lower arms on opposite sides of the knee cap. The releasable pad 9 remains unattached.

Figure 5:
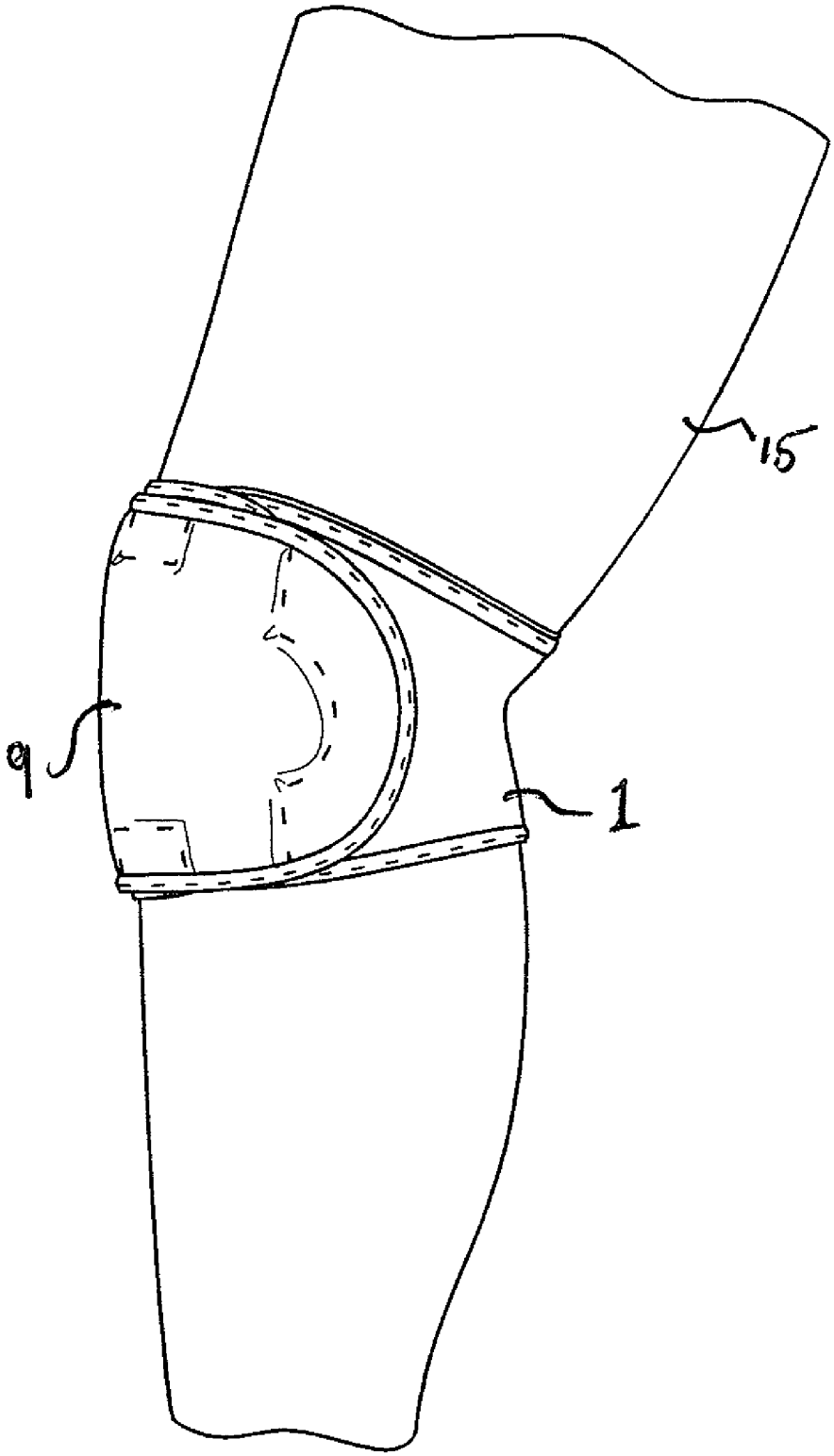
FIG. 5 depicts a fully assembled two-piece knee pad. The stabilizer strap is secured to a human knee in closed formation with the releasable pad attached to the front of the stabilizer strap.

In FIG. 5, the stabilizer strap 1 is shown again in closed formation around the wearer's leg 15, this time with pad 9 attached to the front of the stabilizer strap. Pad 9 attaches across the front surface of the stabilizer strap, covering the upper and lower arms (not shown) as well as the window formed between the arms (also not shown). The pad 9 is positioned to cover the front of the knee and absorb minor impact.

While the invention herein has been particularly described with specific reference to particular embodiments, it will be appreciated that various alterations, modifications, and adaptions may be based on the present disclosure, and are intended to be within the spirit and scope of the present invention as defined by the following claims.

What is claimed is:

1. A two piece knee pad, the knee pad comprising:

a knee cap stabilizer strap which includes a back support panel and two forked portions each of which have a top arm and a bottom arm that are effective to wrap around above and below a human knee to anchor the strap to a wear's leg, the arms of each of the forked portions extending from the back support panel creating a window for the knee when it is strapped to the wearer, the forked portions extending from the back support panel such that the top and bottom arms of each fork section extend away from the top and bottom arms of the other fork section; and a releasable pad portion releasably attached to the knee cap stabilizer strap when the strap is on a wearer's knee without removal of the strap, the releasable pad positioned to cover the window for the knee and to protect the knee when the releasable pad is attached to the stabilizer strap; and wherein the releasable pad includes an inner surface, an outer surface, and a cushion, and the knee cap stabilizer strap includes an inner surface and an outer surface, the arms of the forked portions including proximal ends at the ends where the arms have bases which are attached to the back support panel and distal ends opposite the proximal ends, the inner surface of the releasable pad having a peripheral area which includes a first mating section of a hook and loop fastener, the cushion located on the inner surface inward from the outer circumference of the releasable pad and inward from the peripheral area of the pad, the outer surface of the knee cap stabilizer strap having a second mating section that secures the first mating section of the hook and loop fastener, the releasable pad overlying the distal ends of the arms of the stabilizer strap;

wherein the back support panel of the knee cap stabilizer strap has a length which is to be wrapped horizontally around the back of the knee and a height which runs vertically behind the knee when worn, and the forked portions of the knee cap stabilizer strap has a length which is to be wrapped horizontally around the knee and a width runs vertically up and down the leg when worn, the width of the back support panel being less than the widths of the forked portions of the knee stabilizer strap;

wherein the releasable pad includes a top stretchable fabric substrate and a top exterior stretchable fabric surface, a bottom stretchable fabric substrate and a plurality of spaced separate resilient foam elements sandwiched between and adhesively affixed to the top and bottom stretchable fabric substrates.

2. The two piece knee pad as recited in claim 1, wherein the foam elements have surfaces which have an area not greater than 1 square inch.

3. The two piece knee pad as recited in claim 2, wherein the foam elements are hexagonal in shape.

4. The two piece knee pad as recited in claim 1, wherein the bottom and top stretchable fabric substrates are capable of substantial stretching in different coplanar directions.

5. The two piece knee pad as recited in claim 3, wherein the bottom and top stretchable fabric substrates are capable of substantial stretching in different coplanar directions.

6. A two piece knee pad comprising:

a stabilizer strap comprising a flexible, stretchable fabric, the stabilizer strap including a first pair of arms and a second pair of arms, the first pair of arms configured to be releasably secured to the second pair of arms when the stabilizer strap is wrapped around a knee; and a releasable pad releasably attachable to the arms of the stabilizer strap when the first pair of arms of the stabilizer strap is secured to the second pair of arms of the stabilizer strap, the releasable pad including a top stretchable fabric substrate and a top exterior stretchable fabric surface, a bottom stretchable fabric substrate and a plurality of spaced separate resilient foam elements sandwiched between and adhesively affixed to the top and bottom stretchable fabric substrates.

7. The two piece knee pad as recited in claim 6, wherein the foam elements have surfaces which have an area not greater than 1 square inch.

8. The two piece knee pad as recited in claim 7, wherein the foam elements are hexagonal in shape.

9. The two piece knee pad as recited in claim 6, wherein the bottom and top stretchable fabric substrates are capable of substantial stretching in different coplanar directions.

10. A method for protecting a knee, comprising:

securing a stabilizer strap around a leg by securing a first arm from a first side of the stabilizer strap to a first arm from a second side of the stabilizer strap at a location above a kneecap; securing a second arm from the first side of the stabilizer strap to a second arm from the second side of the stabilizer strap at a location below the kneecap; after securing the stabilizer strap releasably attaching a pad to one of the first arms and one of the second arms such that the pad covers the knee cap;

providing a cushion attached to the pad, and attaching the pad to the stabilizer strap such that the cushion faces the knee cap; and wherein the releasable pad includes a top stretchable fabric substrate and a top exterior stretchable fabric surface, a bottom stretchable fabric substrate and a plurality of spaced separate resilient foam elements sandwiched between and adhesively affixed to the top and bottom stretchable fabric substrates.

11. The method of claim 10, wherein the foam elements have surfaces which have an area not greater than 1 square inch.

12. The method of claim 11, wherein the foam elements are hexagonal in shape.

13. The two piece knee pad as recited in claim 1, wherein the top fabric substrate and the top exterior fabric surface form the same substrate.

14. The two piece knee pad as recited in claim 6, wherein the top fabric substrate and the top exterior fabric surface form the same substrate.

15. The method of claim 10, wherein the top fabric substrate and the top exterior fabric surface form the same substrate.

* * * * *